US006254650B1

(12) United States Patent
Dounis

(10) Patent No.: US 6,254,650 B1
(45) Date of Patent: Jul. 3, 2001

(54) FUEL OIL ADDITIVES AND COMPOSTIONS

(75) Inventor: Panagiotis Dounis, Oxfordshire (GB)

(73) Assignee: Exxon Chemical Patents Inc, Linden, NJ (US)

( * ) Notice: Subject to any disclaimer, the term of this patent is extended or adjusted under 35 U.S.C. 154(b) by 0 days.

(21) Appl. No.: 09/203,694

(22) Filed: Dec. 2, 1998

(30) Foreign Application Priority Data

Dec. 3, 1997 (GB) ..... 9725582

(51) Int. Cl.[7] ..... C10L 1/18; C10L 1/22

(52) U.S. Cl. ..... 44/393; 44/394; 44/395; 44/397; 44/400; 44/403

(58) Field of Search ..... 44/393, 397, 400, 44/403, 394, 395

(56) References Cited

U.S. PATENT DOCUMENTS

| | | | | |
|---|---|---|---|---|
| 3,250,599 | * | 5/1966 | Kirk et al. . | |
| 3,600,311 | | 8/1971 | Naiman et al. . | |
| 3,762,888 | * | 10/1973 | Koher . | |
| 4,014,662 | * | 3/1977 | Miller et al. . | |
| 4,015,952 | * | 4/1977 | Durand et al. . | |
| 4,021,207 | * | 5/1977 | Durand et al. . | |
| 4,147,520 | | 4/1979 | Ilnyckyi . | |
| 4,210,424 | | 7/1980 | Feldman et al. . | |
| 4,211,534 | | 7/1980 | Feldman . | |
| 4,251,232 | | 2/1981 | Brois et al. . | |
| 4,367,074 | * | 1/1983 | Maldonado et al. . | |
| 4,631,071 | | 12/1986 | Axelrod et al. . | |
| 4,639,256 | | 1/1987 | Azelrod et al. . | |
| 5,045,088 | * | 9/1991 | More et al. | 44/393 |
| 5,310,490 | * | 5/1994 | Struglinski et al. . | |
| 5,310,814 | * | 5/1994 | Struglinski et al. . | |
| 5,478,368 | * | 12/1995 | Lebtas | 44/394 |
| 5,543,469 | * | 8/1996 | Struglinski et al. | 508/591 |
| 5,755,834 | * | 5/1998 | Chandler | 44/386 |

FOREIGN PATENT DOCUMENTS

| | | |
|---|---|---|
| 0 153716 | 8/1985 | (EP) . |
| 0153177 | 8/1985 | (EP) . |
| 0 225 668 | 6/1987 | (EP) . |
| 255 345 A1 | 2/1988 | (EP) . |
| 0 403 097 | 12/1990 | (EP) . |
| 1 263 152 | 2/1972 | (GB) . |
| 1468791 | 3/1977 | (GB) . |
| 1490563 | 11/1977 | (GB) . |
| 2087425 | 5/1982 | (GB) . |
| 2121807 | 1/1984 | (GB) . |
| WO 91/16407 | 10/1991 | (WO) . |
| WO 92/16567 | 10/1992 | (WO) . |
| WO 92/16568 | 10/1992 | (WO) . |
| WO 93/08243 | 4/1993 | (WO) . |
| WO 96/28523 | 9/1996 | (WO) . |
| WO 98/03614 | 1/1998 | (WO) . |

OTHER PUBLICATIONS

"Comb–Like Polymers. Structure and Properties", N. A. Plate and V. P. Shivaev, J.Poly.Sci. Macromolecular Revs., 8,p 117 ot 253 (1974), month unavailable.

"Industrial Waxes" by H. Bennett published in 1975, month unavailable.

* cited by examiner

*Primary Examiner*—Margaret Medley

(57) ABSTRACT

A composition comprising a hydrogenated block diene polymer and saturated hydrocarbon mixture as a cold flow improver in an oil.

17 Claims, No Drawings

FUEL OIL ADDITIVES AND COMPOSTIONS

This invention relates to oil compositions, primarily to fuel oil compositions, and more especially to fuel oil compositions susceptible to wax formation at low temperatures, to additives for use in such fuel oil compositions, and to the use of the additives to improve the cold flow properties of fuels.

Fuel oils, whether derived from petroleum or from vegetable sources, contain components, e.g., alkanes, that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter than are platelets. The additives may also have the effect of retaining in suspension in the fuel the crystals that have formed, the resulting reduced settling also assisting in prevention of blockages.

Effective wax crystal modification (as measured by cold filter plugging point (CFPP) and other operability tests as well as simulated and field-performance) may be achieved by flow improvers, for example, by ethylene-vinyl acetate (EVAC) or propionate copolymers.

The present invention provides an additive composition, suitable to improve cold flow characteristics of an oil, comprising (i) an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations, (ii) a mixture of saturated hydrocarbons, at least some of which have a number of carbon atoms within the range of from 15 to 60, and (iii) a wax growth arrestor.

The invention also provides the use of a composition comprising components (i) and (ii) as a nucleating agent to improve the cold flow properties of an oil.

In British Specification No. 1490563, there is disclosed the use of a hydrogenated homopolymer of butadiene or a copolymer of butadiene with a $C_5$ to $C_8$ diene as a cold flow improver for fuels. The copolymer is produced by polymerizing, e.g., a butadiene-isopropene mixture. GB-A-2087425 describes the use of a reaction product of a cyclic anhydride with an N-alkyl polyamine combined with, inter alia, a hydrogenated butadiene-isoprene copolymer.

WO 92/16567, the entire disclosure of which is incorporated herein by reference, describes hydrogenated block copolymers of butadiene and, inter alia, isoprene, and oleaginous compositions containing them. Their use is predominantly as viscosity index improvers in lubricating oils, but there are also references to use in fuels.

WO 92/16568, the entire disclosure of which is incorporated herein by reference, describes hydrogenated block polymers containing 1,4-butadiene and 1,2-butadiene addition products. Their uses are said to be similar to those of the polymers of WO 92/16567.

Advantageously, the hydrogenated block copolymer used in the present invention comprises at least one substantially linear crystallizable segment or block and at least one segment or block that is essentially not crystallizable. Without wishing to be bound by any theory, it is believed that when butadiene is homopolymerized with a sufficient proportion of 1,4 (or end-to-end) enchainments to provide a substantially linear polymeric structure then on hydrogenation it resembles polyethylene and crystallizes rather readily; when a branched diene is polymerised on its own or with butadiene a branched structure will result (e.g., a hydrogenated polyisoprene structure will resemble an ethylene-propylene copolymer) that will not readily form crystalline domains but will confer fuel oil solubility on the block copolymer.

Advantageously, the block copolymer before hydrogenation comprises units derived from butadiene only or from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

After hydrogenation, the copolymer advantageously contains at least 10%, preferably at least 20%, and most preferably from 25 to 60%, by weight of at least one crystalline or crystallizable segment composed primarily of methylene units; to this end the crystallizable segment before hydrogenation advantageously has an average 1,4 or end-to-end enchainment of at least 70 preferably at least 85, mole per cent. The hydrogenated block copolymer comprises at least one low crystallinity (or difficultly crystallizable) segment composed of methylene and substituted methylene units, derived from one or more alkyl-substituted monomers described above, e.g., isoprene and 2,3-dimethylbutadiene.

Alternatively, the low crystallinity segment may be derived from butadiene by 1,2 enchainment, in which the segment has before hydrogenation an average 1,4 enchainment of butadiene of at most 30, preferably at most 10, percent. As a result, the polymer comprises 1,4-polybutadiene as one block and 1,2-polybutadiene as another. Such polymers are obtainable by, e.g., adding a catalyst modifier, as described in the above-identified WO92/16568.

A further advantageous block copolymer is a hydrogenated tapered block or segmented copolymer, advantageously of butadiene and at least one other conjugated diene, preferably isoprene. Such a block copolymer may be obtained by anionically copolymerizing in hydrocarbon solution in, for example, a batch reactor, a mixture containing butadiene monomer and at least one other conjugated diene monomer to form a precursor copolymer having at least 75 weight percent 1,4-configuration of the butadiene and at least one other conjugated diene and then hydrogenating said precursor copolymer.

During the initial formation of the unhydrogenated precursor copolymer of butadiene and at least one other conjugated diene, butadiene will be preferentially polymerized. The concentration of monomers in solution changes during the course of the reaction in favour of the other conjugated diene as the butadiene is depleted. The result is a precursor copolymer in which the copolymer chain is higher in butadiene concentration in the chain segments grown near the beginning of the reaction and higher in the other conjugated diene concentration in the chain segments formed near the end of the reaction. These copolymer chains are accordingly described as tapered in composition. Upon hydrogenation the butadiene rich portion of the polymer becomes rich in methylene units. Therefore, in each of these hydrogenated generally linear copolymer molecules two longitudinal segments are present, gradually merging into each other without sharp boundaries. One of the outer segments consists nearly completely of methylene units derived from the hydrogenation of the butadiene in the 1,4-configuration and contains only small amounts of substituted methylene units derived from the hydrogenation of the other conjugated diene such as isoprene. The second segment is relatively rich in substituted methylene units derived, for example, from the hydrogenation of the isoprene in the 1,4-configuration. The first segment, which is rich in methylene units, comprises the crystallizable segment, advantageously containing more than 20 mole percent 1,4-polybutadiene. The second outer segment comprises the low crystallinity segment, advantageously containing less than 20 mole percent 1,4-polybutadiene units. In these tapered block copolymers the crystallizable segment typically comprises an average of at least 20 mole percent of the copolymer's chain.

The weight percent of the butadiene present in the reaction mixture is that effective to form a tapered segmented or block copolymer having at least one crystallizable block and at least one non-crystallizable block. Generally this amount of butadiene is from 20 to 90 weight percent. Additionally, the proportion of the 1,4-configuration butadiene present in the precursor copolymer is that effective to form a crystallizable segment upon hydrogenation of the precursor copolymer. Generally, this proportion is at least 80 weight percent.

A further advantageous block copolymer is a star copolymer having from 3 to 25, preferably 5 to 15, arms.

Advantageous embodiments of block copolymers are those comprising a single crystallizable block and a single non-crystallizable block and those comprising a single non-crystallizable block having at each end a single crystallizable block. Other tri- and tetra-block copolymers are also suitable.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

Advantageously the molecular weight, Mn, of the hydrogenated block copolymer, measured by GPC, lies in the range of 500 to 100,000, more advantageously 500 to 20,000, preferably 500 to 10,000 and more preferably from 3,000 to 8,000.

Advantageously, in a diblock polymer, the molecular weight of the crystallizable block is from 500 to 20,000, and preferably from 500 to 5,000, and that of the non-crystallizable block is from 500 to 50,000, preferably from 1,000 to 5,000. In a triblock polymer, the molecular weight of each crystallizable block is advantageously from 500 to 20,000, advantageously about 5,000, and that of the non-crystallizable block is from 1,000 to 20,000, preferably 1,000 to 5,000.

The proportion of the total molecular weight of a block copolymer represented by a crystalline block or blocks may be determined by H or C NMR, and the total molecular weight of the polymer by GPC.

As indicated in more detail in the above-identified PCT Application WO 92/16567, the precursor block copolymers are conveniently prepared by anionic polymerization, which facilitates control of structure and molecular weight, preferably using a metallic or organometallic catalyst. Hydrogenation is effected employing conventional procedures, using elevated temperature and hydrogen pressure in the presence of a hydrogenation catalyst, preferably palladium on barium sulphate or calcium carbonate or nickel octanoate/triethyl aluminium.

Advantageously, at least 90% of the original unsaturation (as measured by NMR spectroscopy) is removed on hydrogenation, preferably at least 95%, and more preferably at least 98%.

As indicated above, components (i) and (ii) are nucleating agents.

Advantageously, the saturated hydrocarbon mixture, component (ii), comprises normal (linear) alkanes. Advantageously, the mixture has a boiling range from about 230 to 510° C. Advantageously, the mixture contains a spread of at least 16 carbon atoms from the lowest to the highest carbon number. Preferably, the mixture contains a substantial proportion of $C_{24}$ to $C_{32}$, more preferably a substantial proportion of $C_{24}$ to $C_{28}$, hydrocarbons, by weight. Advantageously, the number average molecular weight is in the range of 350 to 450. Advantageously, the mixture is a wax.

Waxes have conventionally been defined by reference to their physical characteristics, in view of the large and varied number of hydrocarbon components which they contain, and the difficulties in separating such closely related, and often homologous, hydrocarbon molecules. "Industrial Waxes", H. Bennett, 1975, describes the different types of petroleum wax and indicates that the characteristics of melting point and refractive index have proved useful in classifying the variety of waxes available from different sources. Waxes are also typically described in terms of their n-alkane content.

When component (ii) is a mixture of mixtures, especially two or more mixtures of normal and non-normal alkanes, this may be apparent from chromatographic characterization, which would show a bi- or multi-modal distribution of carbon numbers. In general, an n-alkane wax has a maximum in the carbon number distribution at a lower carbon number than does a non n-alkane wax.

The wax may be an n-alkane wax or non n-alkane wax. The term "n-alkane wax" is used in this specification to mean a wax which comprises 40% or more n-alkanes by weight, based on the total weight of that wax.

Similarly, the term, "non n-alkane wax" is used in this specification to mean a wax which comprises less than 40% n-alkanes by weight, based on the total weight of that wax. Preferably, an n-alkane wax contains at least 55%, more preferably at least 60%, n-alkanes by weight. Preferably, a non n-alkane wax contains less than 35%, more preferably less than 30%, for example less than 20% or 15%, n-alkanes by weight.

More preferably, the n-alkane wax is a slack wax, for example, a slack wax obtained from dewaxing of heavy gas oils having viscosities equivalent to the lubricant viscosity ranges of 90 neutral to 400 neutral, for example: slackwax 90 neutral, slackwax 130 neutral, slackwax 150 neutral and slackwax 400 neutral. Such waxes normally comprise a range of hydrocarbon components containing between 15 and 60 carbon atoms, with the n-alkane distribution typically being n-$C_{15}$ to n-$C_{50}$, for example, n-$C_{15}$ to n-$C_{45}$.

Further examples of n-alkane waxes suitable for use in this invention include the various grades of "Shell wax", particularly Shellwax 130/135 and 125/130.

The non n-alkane wax may be a slackwax derived from a heavier viscosity stream (for example, slackwax 600 neutral) or a petrolatum or foots oil material.

The non n-alkane wax is preferably one having a melting point of 42 to 59° C. and a refractive index of 1.445 to 1.458. (Refractive index as used in this specification is measured according to ASTM D1747-94, at a temperature of 70° C.)

The melting point of a non n-alkane wax useful in the present invention is advantageously in the range of 44° C. to 55° C., preferably 45° C. to 53° C., and more preferably 47° C. to 53° C. Melting point as used in this specification is measured according to ASTM D938.

The refractive index of a wax useful in the present invention is preferably in the range of 1.445 to 1.455, more preferably in the range of 1.447 to 1.454, and most preferably in the range of 1.445 to 1.453, particularly in the range of 1.451 to 1.453.

Particularly suitable non n-alkane waxes have the following combinations of melting point and refractive index, measured according to the above-defined tests:

(i) advantageously a melting point in the range of 42° C. to 59° C. and a refractive index in the range of 1.445 to 1.455;

(ii) preferably a melting point in the range of 44° C. to 55° C. and a refractive index in the range of 1.447 to 1.454;

(iii) more preferably a melting point in the range of 45° C. to 53° C. and a refractive index in the range of 1.445 to 1.453; and (iv) most preferably a melting point in the range of 47° C. to 53d and a refractive index in the range of 1.451 to 1.453.

Surprisingly, it has been found that mixtures of different petroleum waxes have properties particularly useful for improving the low temperature flow properties of oils, and especially fuel oils, e.g., middle distillate fuel oils. Whilst not wishing to be bound by any particular theory, it is postulated that wax mixtures possess a combination of components which interact very favourably with precipitating n-alkanes present within the oil and with any further low temperature flow improver also present in the oil, such that the detrimental effects of precipitation of the wax inherent in the oil are reduced or even prevented.

Mixtures of two or more such waxes may show better performance in low temperature flow improver applications than a single wax.

Preferred wax mixtures are those in which at least one wax is an n-alkane wax and at least one wax is a non n-alkane wax.

Additives comprising one or more n-alkane slack waxes with one or more of the above forms of wax (i) to (iv) are particularly advantageous as flow improver compositions.

In a mixture of waxes, more than one of each type of wax may be used with advantage.

The different waxes used according to this invention are typically obtained by appropriate separation and fractionation of different wax-containing distillate fractions, and are available from wax suppliers.

The composition may contain two or more components (i), and two or more components (ii), and advantageously it contains two or more arrestors (iii). A composition containing two or more mixtures of hydrocarbons (ii) may be advantageous if the mixtures differ in their carbon number contents.

The additive may comprise additional nucleating agents. Among these there may be mentioned more especially a polyoxyalkylene ester, ether, ester/ether, amide/ester, or a mixture of two or more thereof, especially those containing at least one, preferably at least two, $C_{10}$ to $C_{39}$, advantageously linear, saturated aliphatic groups, and a polyoxyalkylene glycol of molecular weight 100 to 5000, preferably 200 to 5000, the alkylene groups advantageously containing from 1 to 4 carbon atoms. Preferred glycols are polyethylene and polypropylene glycols. Mixtures of glycols of different molecular weights may be used, and are in some cases preferred. Particularly preferred are mixtures of glycols of molecular weight of about 200, 400, and 600. Esters are preferred, the esters of fatty acids containing from 10 to 30, more especially from 18 to 22, carbon atoms being particularly preferred, for example, behenic and stearic acids.

As another group of materials suitable as additional nucleating agents, there may be mentioned $C_8$ to $C_{32}$ hydrocarbyl esters of tertiary amine-substituted aliphatic carboxylic acids. More especially, there may be mentioned compounds of the formula $$(R^1R^2N)_e\text{-}A\text{-}(NR^1R^3)_f$$

or $$BNR^1{}_2$$

wherein A represents an (e+f) valent and B represents a monovalent hydrocarbon radical optionally interrupted by at least one heteroatom selected from oxygen and nitrogen, each $R^1$ independently represents $$—CHR^4(CHR^5)_pCOOR^6,$$

$R^2$ and $R^3$ each independently represent $R^1$, H, or an alkyl group containing from 1 to 8 carbon atoms, $R^4$ and $R^5$ each independently represent H or an alkyl group containing from 1 to 8 carbon atoms, $R^6$ represents a hydrocarbyl group containing from 8 to 32 carbon atoms optionally interrupted by at least one hetero atom selected from oxygen and nitrogen, e and f each represent an integer up to 12 or zero provided that the total number of $R^1$ groups is at least 2, and p represents zero or an integer within the range of from 1 to 4. Further details of such compounds are set out in International Patent Application No. WO 98/03614 the disclosure of which is incorporated by reference, herein.

Advantageously, A or B represents a radical containing from 1 to 200, preferably from 2 to 65, carbon atoms. A or B may represent a saturated aliphatic radical or a radical of the formula $$—[CH(CH_3)CH_2O]_a—[CH_2CH_2O]_b—[CH_2CH(CH_3)O]_c—CH_2CH(CH_3)—,$$

where a+c is within the range of 2 to 4 and b is within the range of 5 to 100.

A preferred member of this group is a $C_{18}$ to $C_{22}$ mixed alkyl tetraester of hexane diamine tetrapropionic acid.

As another group of materials suitable as additional nucleating agents, there may also be mentioned ethylene-vinyl ester copolymer nucleators; such nucleator copolymers advantageously have a number average molecular weight in the range of from 3,000 to 20,000, advantageously from 1,200 to 10,000, more especially from 4,500 to 8,000, and especially about 5,000, and an ester content, e.g., advantageously less than 7.5, preferably from 0.3 to 7.5, and preferably from 3.5 to 7.0, molar per cent.

As wax growth arrestor, component (iii) of the additive composition, there may be mentioned, for example, an ionic or non-ionic polar nitrogen compound.

Such compounds, which are oil-soluble, advantageously include at least one, preferably at least two, substituents of the formula $>NR^3$, where $R^3$ represents a hydrocarbyl group containing 8 to 40 carbon atoms, which substituent or one or more of which substituents may be in the form of a cationic derivative. As examples there may be mentioned the following groups of compounds:

(a) An amine salt and/or amide obtainable by the reaction of at least one molar proportion of a hydrocarbyl substituted amine with a molar proportion of a hydrocarbyl acid having from 1 to 4 carboxylic acid groups or an anhydride thereof, the substituent(s) having the formula $>NR^3$ advantageously being of the formula $—NR^3R^4$ where $R^3$ is as defined above and $R^4$ represents hydrogen or $R^3$, provided that $R^3$ and $R^4$ may be the same or different, said substituents constituting part of the amine salt and/or amide groups of the compound.

Advantageously, ester/amides containing 30 to 300, preferably 50 to 150, total carbon atoms are used, these nitrogen compounds being described in U.S. Pat. No. 4,211,534. Preferred amines are $C_{12}$ to $C_{40}$ primary, secondary, tertiary or quaternary amines or mixtures thereof, although shorter chain amines may be used provided the resulting nitrogen compound is oil soluble. The nitrogen compound advantageously contains at least one linear $C_8$ to $C_{40}$, preferably $C_{14}$ to $C_{24}$, alkyl segment.

Secondary amines are preferred, tertiary and quaternary amines only forming amine salts. As examples of amines there may be mentioned tetradecylamine, cocoamine, and hydrogenated tallow amine. Examples of secondary amines include dioctadecylamine and methyl-behenylamine. Amine mixtures are also suitable, for example, those derived from natural materials. A preferred amine is a secondary hydrogenated tallow amine of the formula $HNR^1R^2$ wherein $R^1$ and $R^2$ are alkyl groups derived from hydrogenated tallow fat-(normally composed of approximately 4% $C_{14}$, 31% $C_{16}$, 59% $C_{18}$ alkyl groups).

Examples of suitable carboxylic acids and their anhydrides for preparing the nitrogen compounds include cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactone. Generally, these acids have from 5 to 13 carbon atoms in the cyclic moiety. Preferred acids are the benzene dicarboxylic acids, phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of hydrogenated tallow amine. Another preferred compound is the diamide formed by dehydrating this amide-amine salt.

Other examples are long chain alkyl or alkylene substituted dicarboxylic acid derivatives, for example the amine salts of monoamides of substituted succinic acids, examples of which are known in the art and described, for example, in U.S. Pat. No. 4,147,520. Suitable amines may be those described above.

Other examples are condensates, for example, those described in EP-A-327,423.

(b) A compound comprising a ring system, the compound carrying at least two, but preferably only two, substituents of the general formula (I) below on the ring system $$-A-NR^5R^6 \quad (I)$$

where A is an aliphatic hydrocarbylene group optionally interrupted by one or more hetero atoms and that is straight chain or branched, and $R^5$ and $R^6$ are the same or different and each is independently a hydrocarbyl group containing 9 to 40, advantageously from 16 to 40, preferably from 16 to 24, carbon atoms, optionally interrupted by one or more hetero atoms, the substituents being the same or different and the compound optionally being in the form of a salt thereof. Advantageously, $R^5$ and $R^6$ are linear, and advantageously $R^5$ and $R^6$ are alkyl, alkenyl, or an alkyl-terminated mono- or polyoxyalkylene group.

Advantageously, A contains from 1 to 20 carbon atoms and is preferably a methylene or polymethylene group.

The ring system may comprise homocyclic, heterocyclic, or fused polycyclic assemblies, or a system where two or more such cyclic assemblies are joined to one another, and in which the cyclic assemblies may be the same or different. Where there are two or more such cyclic assemblies, the substituents of the formula $-A-NR^5R^6$ may be on the same or different assemblies, but are preferably on the same assembly. Preferably, the or each cyclic assembly is aromatic, more preferably a benzene ring. Most preferably, the cyclic ring system is a single benzene ring, when it is preferred that the substituents are in the ortho or meta positions, the ring being optionally further substituted.

The ring atoms in the cyclic assembly or assemblies are preferably carbon atoms but may for example include one or more ring N, S or O atoms.

Examples of polycyclic assemblies include condensed benzene structures, e.g., naphthalene, anthracene, phenanthrene, and pyrene; condensed ring structures containing rings other than benzene, e.g., azulene, indene, hydroindene, fluorene, and diphenylene oxides: rings joined "end-on", e.g., diphenyl; heterocyclic compounds e.g., quinoline, indole, 2,3-dihydroindole, benzofuran, coumarin, isocoumarin, benzothiophen, carbazole and thiodiphenylamine; non-aromatic or partially saturated ring systems e.g., decalin (decahydronaphthalene), α-pinene, cardinene, and bornylene; and bridged ring structures e.g., norbornene, bicycloheptane (i.e. norbornane), bicyclooctane, and bicyclooctene.

(c) A condensate of a long chain primary or secondary amine with a carboxylic acid-containing polymer.

Specific examples include the polymers described in GB-A-2,121,807, FR-A-2,592,387 and DE-A-3,941,561; the esters of telomer acids and alkanoloamines described in U.S. Pat. No. 4,639,256; and the reaction product of an amine containing a branched carboxylic acid ester, an epoxide and a monocarboxylic acid polyester described in U.S. Pat. No. 4,631,071.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl or alkenyl), alicyclic (e.g., cycloalkyl or cycloalkenyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and, preferably, oxygen. Advantageously, the hydrocarbyl group contains at most 30, preferably at most 15, more preferably at most 10 and most preferably at most 8, carbon atoms.

Another group of materials suitable for use as component (iii), the wax growth arrestor, comprises acrylate and methacrylate, hereinafter collectively referred to as (meth) acrylate, homo- and copolymers. Examples of such polymers are copolymers of (meth)acrylic esters of at least two, linear or branched, alkanols containing various numbers of carbon atoms, e.g., from 6 to 40, especially copolymers of methacrylic esters of $C_{18}$ to $C_{22}$ linear alkanols, optionally together with an olefinic monomer, e.g., ethylene, or a nitrogen-containing monomer, e.g., N-vinyl pyridine or a dialkylaminoalkyl (meth)acrylate. The weight average molecular weight, as measured by GPC, of the polymer is advantageously within the range of from 50,000 to 500,000. A presently preferred polymer of this type is a copolymer of methacrylic acid and a methacrylic ester of $C_{14}C_{15}$ saturated alcohols (1:9 molar ratio), the acid groups being neutralized with di(hydrogenated tallow) amine, this material being referred to below as Additive F.

A further group of materials suitable for use as component (iii) comprises ethylene-unsaturated, more especially vinyl, ester copolymers. Without wishing to be bound by theory it is believed that the lower molecular weight copolymers of this class having a relatively high ester content behave primarily as arrestors. Accordingly, there are advantageously used copolymers of such esters, e.g., the acetate, propionate, octanoate (especially the 2-ethylhexanoate), including terpolymers, especially terpolymers of ethylene, vinyl acetate, and a vinyl ester of a $C_2$ to $C_{10}$ alkanecarboxylic acid, especially 2-ethylhexanoic acid. The copolymer advantageously has a number average molecular weight, measured by GPC, of at most 20,000, and more especially from 1,200 to 6,000, preferably 3,000 to 5,000, and especially about 3,500, with a vinyl ester content of at least 7.5 molar per cent, preferably from 7.5 to 35 molar per cent.

A further group of materials suitable for use as component (iii) comprises comb polymers. Such polymers are discussed in "Comb-Like Polymers. Structure and Properties", N. A. Plate and V. P. Shibaev, J. Poly. Sci. Macromolecular Revs., 8, p 117 to 253 (1974).

Advantageously, the comb polymer is a homopolymer having, or a copolymer at least 25 and preferably at least 40, more preferably at least 50, molar per cent of the units of which have, side chains containing at least 6, and preferably at least 10, atoms.

As examples of preferred comb polymers there may be mentioned those of the general formula

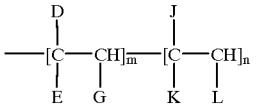

Wherein

D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$, or COOH,

L=H, $R^{12}$, $COOR^{12}$, $OCOR^{12}$, COOH, or aryl, $R^{11}$=$C_{10}$ hydrocarbyl, $R^{12}$=$C_1$ hydrocarbyl or hydrocarbylene, and m and n represent mole ratios, m being within the range of from 1.0 to 0.4, n being in the range of from 0 to 0.6. $R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g., an α-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decanol, n-dodecan-1-ol, n-tetradecan-l-ol, n-hexadecan-l-ol, and n-octadecan-1-ol. The alcohols may also include up to one methyl branch per chain, for example, 1-methylpentadecan-1-ol, 2-methyltridecan-l-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, 153177 and 225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous.

The additive composition may contain other additives for improving low temperature, and/or other properties, many of which are in use in the art or known from the literature.

The additive composition of the invention may also comprise a copolymer of ethylene and at least one α-olefin, having a number average molecular weight of at least 30,000. Preferably the α-olefin has at most 20 carbon atoms. Examples of such olefins are propylene, 1-butene, isobutene, n-octene-l, isooctene-l, n-decene-l, and n-dodecene-1. The copolymer may also comprise small amounts, e.g, up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is, as indicated above, at least 30,000, as measured by GPC relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially-amorphous, since highly crystalline polymers are relatively insoluble in fuel oil at low temperatures.

The additive composition may also comprise a further ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent although for ethylene-propylene copolymers up to 86 molar per cent by weight ethylene may be employed with advantage.

The invention also provides an oil containing the additive composition, and an additive concentrate comprising the additive composition in admixture with an oil or a solvent miscible with the oil. The invention further provides the use of the additive composition to improve the low temperature properties of an oil. The oil may be a crude oil, i.e. oil obtained directly from drilling and before refining, the compositions of this invention being suitable for use as flow improvers therein.

The oil may be a lubricating oil, which may be an animal, vegetable or mineral oil, such, for example, as petroleum oil fractions ranging from naphthas or spindle oil to SAE 30, 40 or 50 lubricating oil grades, castor oil, fish oils or oxidized mineral oil. Such an oil may contain additives depending on its intended use; examples are viscosity index improvers such as ethylene-propylene copolymers, succinic acid based dispersants, metal containing dispersant additives and zinc dialkyl-dithiophosphate antiwear additives. The compositions of this invention may be suitable for use in lubricating oils as flow improvers, pour point depressants or dewaxing aids.

The oil may be a fuel oil, especially a middle distillate fuel oil. Such distillate fuel oils generally boil within the range of from 110° C. to 500° C., e.g. 150° to 400° C.

The invention is applicable to middle distillate fuel oils of all types, including the broad-boiling distillates, i.e., those having a 90%-20% boiling temperature difference, as measured in accordance with ASTM D-86, of 100° C. or more and an FBP - 90% of 30° C. or more, and more especially to the more difficult to treat narrow boiling distillates, having a 90%-20% boiling range of less than 100° C., especially of less than 85° C.

The fuel oil may comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt. %, of vacuum gas oil or cracked gas oils or of both.

The additive composition of the invention is especially useful in connexion with fuel oils of high wax content, e.g., a wax content above 3% by weight, for example, at least 3.5% by weight, at 10° C. below cloud point, and a narrow boiling range, but is also suitable for use in other fuel oils. The invention is also applicable to vegetable-based fuel oils, for example rape seed oil, used alone or in admixture with a petroleum distillate oil.

The additive should preferably be soluble in the oil to the extent of at least 1000 ppm by weight per weight of oil at ambient temperature. However, at least some of the additive may come out of solution near the cloud point of the oil and function to modify the wax crystals that form.

In addition, the additive composition and the fuel oil composition may contain additives for other purposes, e.g., for reducing particulate emission or inhibiting colour and sediment formation during storage.

The fuel oil composition of the invention advantageously contains the additive of the invention, i.e., components (i), (ii), and (iii), above, in a total proportion of 0.0005% to 2.5%, preferably 0.01% to 0.26% by weight, based on the weight of fuel.

Components (i) and (ii) are advantageously present in a weight ratio of from 1:15 to 1:1, preferably from 1:10 to 1:3, while the weight ratio of components (i) and (ii) combined to component (iii) is advantageously in the ratio preferably 1:1 to 5:1, preferably 3:2 to 2:1.

Component (i) advantageously represents at most 25% of the total weight of components (i), (ii) and (iii).

The following Examples, in which parts and percentages are by weight, illustrate the invention:

The following fuels were used in the Examples

| | Fuel 1 | Fuel 2 |
|---|---|---|
| Cloud Point, ° C. | −1 | −5.5 |
| CFPP, ° C. | −2 | −5.5 |
| ASPP, ° C. | | −5 |
| IBP,° C. | 223 | 179 |
| FBP, ° C. | 365 | 350 |
| 90–20, ° C. | 61 | 82 |
| FBP-90, ° C. | 28 | 17 |
| WAT, ° C. | −5 | −9 |
| % Wax at 5° C. below Cloud Point | | 2.4 |
| At 10° C. below | 3.9 | 3.9 |

CFPP is measured as described in "Journal of the Institute of Petroleum", 52 (1966), 173.

In the Examples below, the following materials were used as additives.

| Additive | Material |
|---|---|
| A | Hydrogenated butadiene/isoprene diblock copolymer, blocks of Mn 1500 and 5000 respectively |
| B | ethylene-vinyl acetate nucleator copolymer containing 13.5% vinyl acetate |
| C | Shell Wax 130/135 |
| D | ethylene-vinyl acetate arrestor copolymer containing 36.5% vinyl acetate, Mn 3500 by GPC |
| E | Half amide half amine salt adduct of phthalic acid and di(hydrogenated tallow) amine |
| F | Poly(methacrylate) |
| G | n $C_{14}$ alkyl fumarate-vinyl acetate comb polymer |

Additives A to C are nucleators, additives D to G are arrestors.

In addition to the CFPP test, identified above, the pour points of the treated fuels were measured by ASTM D 97 and the fuels were also subjected to the ASPP-GT test, which is carried out as described in EP-A-403 097 with the temperature being lowered at 20° C. per hour. In a preferred embodiment of the invention, depression of CFPP and ASPP values of greater than 15° C. and 10° C. are obtained.

COMPARATIVE EXAMPLES A AND B

In these Examples, the lowering of CFPP in two fuels using previously proposed materials as nucleators was examined. These employed as nucleators additives B and C in each of the two fuels, together with arrestors D and E in both fuels and, in Fuel 2 only, comb polymer F. The fuels were subjected to the standard CFPP test.

| | Example A Additive and Treat Rate, ppm Fuel 1 | Example B Additive and Treat Rate, ppm Fuel 2 |
|---|---|---|
| B | 250 | 320 |
| C | 1000 | 1000 |
| D | 250 | 320 |
| E | 250 | 320 |
| F | | 35 |
| Total Treat Rate | 1750 | 1995 |
| CFPP, ° C. | −14 | −16 |

EXAMPLES 1 AND 2

In these examples, the procedure of Comparative Examples A and B was followed, but using the hydrogenated copolymer A instead of the ethylene-vinyl acetate copolymer B.

| | Example 1 Additive and Treat Rate, ppm Fuel 1 | Example 2 Additive and Treat Rate, ppm Fuel 2 |
|---|---|---|
| A | 250 | 322 |
| C | 1000 | 1000 |

-continued

| | Example 1 Additive and Treat Rate, ppm Fuel 1 | Example 2 Additive and Treat Rate, ppm Fuel 2 |
|---|---|---|
| D | 250 | 322 |
| E | 250 | 322 |
| F | | 34 |
| Total Treat Rate | 1750 | 2000 |
| CFPP, ° C. | −18 | −19 |

The results of Examples 1 and 2 show that at these treat rates the hydrogenated copolymers employed as nucleators in compositions according to the invention provide an improved lowering of CFPP of the fuels under consideration compared with corresponding compositions employing a commercially available ethylene-vinyl acetate copolymer nucleator.

EXAMPLES 3 to 6

Further CFPP and ASPP evaluations were carried out on Fuel 2, using component A at various treat rates.

| | Additive and Treat Rate, ppm | | | | | | | | |
|---|---|---|---|---|---|---|---|---|---|
| Ex No | A | C | D | E | F | G | Total | CFPP ° C. | ASPP ° C. |
| 3 | 320 | 1000 | — | 320 | 35 | — | 1675 | −9 | |
| 4 | 100 | 1000 | 320 | 320 | 35 | — | 1775 | −15 | −8 |
| 5 | 333 | 1000 | — | 667 | — | — | 2000 | −17 | −15 |
| 6 | 387 | 1000 | 387 | 387 | — | 39 | 2200 | −21 | −18 |

Example 3 to 6 show valuable lowering of CFPP and in some cases of using compositions in accordance with the invention.

I claim:

1. A composition comprising (i) an oil-soluble hydrogenated block butadiene polymer, comprising at least one crystallizable block, obtainable by end-to end polymerization of a linear butadiene, and at least one non-crystallizable block, the non-crystallizable block being obtainable by 1,2-configuration polymerization of a linear diene, by polymerization of isoprene, or by a mixture of such polymerizations, (ii) a mixture of saturated hydrocarbons, at least some of which have a number of carbon atoms within the range of from 15 to 60, and (iii) a wax growth arrestor.

2. A composition as claimed in claim 1, wherein the hydrogenated block copolymer contains at least one crystallizable or crystalline block and at least one non-crystallizable or non-crystalline block.

3. An additive concentration comprising the composition defined in claim 1 in an oil or a solvent miscible with oil.

4. A composition as claimed in claim 1, wherein component (ii) comprises linear alkanes.

5. A composition as claimed in claim 4, wherein component (ii) contains a range of at least 16 carbon atoms from the lowest to the highest carbon number.

6. A composition as claimed in claim 1, wherein component (iii) is a polar nitrogen compound.

7. A composition as claimed in claim 6, wherein component (iii) is an amine salt or an amide obtainable by reaction of at least one molar proportion of a hydrocabyl-substituted amine with a molar proportion of a hydrocarbyl acid having up to 4 carboxyl groups, or an anhydride thereof.

8. A composition as claimed in claim 1, wherein component (iii) is a (meth)acrylate homo- or co-polymer.

9. A composition as claimed in claim 1, wherein component (iii) is an ethylene-unsaturated ester copolymer.

10. A composition as claimed in claim 1, wherein component (iii) is a comb polymer.

11. A composition as claimed in claim 10, wherein the comb polymer is a copolymer of vinyl acetate and a fumarate ester.

12. A composition as claimed in claim 1, further comprising an ethylene-vinyl ester co-polymer nucleator.

13. A composition as claimed in claim 1, further comprising a polyoxyalkylene ester, ester/ether, amide/ester, or a mixture of two or more thereof.

14. A composition as claimed in claim 13, wherein the polyoxyalkylene component is a dibehenate ester, or a mixed behenate and stearate ester, of a mixture of three polyethylene glycols of molecular weights of about 200, 400, and 600.

15. A composition as claimed in claim 1, further comprising a $C_8$ to $C_{32}$ hydrocarbyl ester of a tertiary amine-substituted aliphatic carboxylic acid.

16. A fuel oil composition comprising: 1) a fuel oil base and 2) an additive comprising a composition as claimed in claim 1.

17. An oil composition as claimed in claim 16, which comprises a fuel oil having a wax content of at least 3.5% at 10° C. below cloud point.

* * * * *

UNITED STATES PATENT AND TRADEMARK OFFICE

CERTIFICATE OF CORRECTION

PATENT NO. : 6,254,650 B1
DATED : July 3, 2001
INVENTOR(S) : P. Dounis

It is certified that error appears in the above-identified patent and that said Letters Patent is hereby corrected as shown below:

Claim 1,
Line 2, after "(i)" insert -- a first nucleating agent comprising --.
Line 10, after "(ii)" insert -- a second nucleating agent comprising --.
At the end of claim 1 insert -- selected from the group consisting of polar nitrogen compounds, acrylate and methacrylate homo- or co-polymers, ethylene unsaturated ester copolymers, comb polymers, and mixtures thereof; and components (i) and (ii) being present in a weight ratio of from 1:10 to 1:3, and the weight ratio of components (i) and (ii) combined to component (iii) being present in the ratio of from 3:2 to 2:1 --.

Signed and Sealed this

Twenty-sixth Day of February, 2002

*Attest:*

*Attesting Officer*

JAMES E. ROGAN
*Director of the United States Patent and Trademark Office*